United States Patent [19]

Bouix

[11] Patent Number: 4,750,882

[45] Date of Patent: Jun. 14, 1988

[54] METHOD FOR THE POSITIONING OF A COMPOSITION STICK IN A STICK HOLDER CASE AND A STICK HOLDER CASE FOR CARRYING OUT SUCH METHOD

[75] Inventor: Hervé Bouix, Marly le Roi, France

[73] Assignee: L'Oreal, Paris, France

[21] Appl. No.: 31,135

[22] Filed: Mar. 30, 1987

[30] Foreign Application Priority Data

Apr. 2, 1986 [FR] France ..... 86 04689

[51] Int. Cl.[4] ..... A45D 40/06; A45D 40/16

[52] U.S. Cl. ..... 401/78; 401/68; 401/86; 401/87

[58] Field of Search ..... 401/77, 78, 75, 86, 401/87, 68

[56] References Cited

U.S. PATENT DOCUMENTS

| | | | |
|---|---|---|---|
| 2,529,673 | 11/1950 | Blake | 401/78 |
| 2,753,991 | 7/1956 | Sherman . | |
| 2,858,937 | 11/1958 | Hoffman | 401/78 |
| 3,082,869 | 3/1963 | Bau | 401/86 X |
| 3,230,960 | 1/1966 | Moore et al. . | |
| 3,740,810 | 6/1973 | Austin . | |

FOREIGN PATENT DOCUMENTS

| | | | |
|---|---|---|---|
| 2421971 | 12/1974 | Fed. Rep. of Germany | 401/78 |
| 946797 | 6/1949 | France | 401/78 |
| 1097470 | 7/1955 | France . | |
| 1146533 | 11/1957 | France | 401/78 |
| 1196297 | 11/1959 | France . | |
| 1205370 | 2/1960 | France . | |
| 1592949 | 6/1970 | France . | |
| 2548880 | 7/1983 | France . | |
| 439615 | 12/1967 | Switzerland | 401/78 |
| 686985 | 2/1953 | United Kingdom . | |
| 2,143,212 | 2/1985 | United Kingdom | 401/78 |

*Primary Examiner*—Steven A. Bratlie

*Attorney, Agent, or Firm*—Cushman, Darby & Cushman

[57] ABSTRACT

On the top of a mould above each of several cavities for moulding sticks of lipstick, is disposed a first tubular element of a cup comprising an external device for catch-engagement with a second tubular element of the cup, which second tubular element is intended to cooperate with the rest of the case, namely a shell with its internal liner and sleeve. The composition of the lipstick is cast through the first tubular element portion to fill the cavity and at least partly fill the internal space of the first tubular element. After solidification, the case is brought above each cavity to mount the second tubular element in the upper portion of the case until the second tubular element is catch-engaged on the first tubular element. The unit thus formed is extracted from the mould by upward translation and the lipstick thus cast is retracted into its case.

7 Claims, 1 Drawing Sheet

METHOD FOR THE POSITIONING OF A COMPOSITION STICK IN A STICK HOLDER CASE AND A STICK HOLDER CASE FOR CARRYING OUT SUCH METHOD

FIELD OF THE INVENTION

The present invention concerns stick holder cases and more particularly those wherein the held stick is a lipstick.

PRIOR ART

In cases of this type, the lipstick, which as a general rule has an overall cylindrical shape, is accommodated in a cup which it engages at its base. Generally, the cup has two studs which project radially outwardly, these studs each passing through an opening whose two ends each have a slot extending in a circumferential direction, the direction of one slot at one end being opposite to that of the slot of the other end, and the opening being arranged in the lateral wall of a sleeve wherein the cup is axially displaced; moreover, these studs are each engaged in a helical groove arranged in a cylindrical liner which is externally covered by a shell and which retains the sleeve axially whilst it is free for rotation around its axis. Because of the displacement of the studs guided in the above-mentioned openings and grooves, the driving, in rotation, of one end of the sleeve projecting from the liner entails a helical displacement of the cup in the liner and a translational displacement of the cup in the sleeve between two end positions, that is to say: a first completely retracted position and a second completely extended position of the lipstick. These end positions are attained when the studs come to bear against the ends of the openings and/or of the groove which are situated respectively nearer the bottom of the cup and remote therefrom.

Various methods are known for positioning a lipstick, obtained by the solidification of a composition which can be cast in a hot condition, and the cup associated therewith in the sub-assembly which cup is constituted by the sleeve mounted in the liner surrounded by its shell.

A first method involves inserting the lipstick, once formed, manually with its base into the cup, while the cup is in its high or extended position in the case. In these conditions, unless the case has an oval shape, no precaution has to be taken in order to orientate the case and/or the lipstick angularly; nevertheless the fact remains that if the lipstick is not inserted truly axially into the associated case, fouling may occur due to the rubbing of the lipstick on the upper portion of the case. If the case has an oval shape, it will be readily understood that the risks of fouling are even greater. In both cases, it is therefore necessary to remove these dirty marks manually which represents a serious loss of time within a manufacturing framework on an industrial scale.

A second method lies in effecting the casting through the case. The mould used comprises a plurality of cavities or holes corresponding to the shape of the lipstick to be moulded, these cavities each being delimited by a lateral cylindrical wall and a generally asymmetrical oval bottom. These cavities open out in the upper wall of the mould. The assembled unit constituted by the liner and its external shell, the sleeve and the cup, is then disposed above each cavity, while the cup is in its high position, the unit being disposed so that the cup is adjacent to the cavity of the mould. Since the bottom of the case (that is to say the end face of the knurled wheel forming the portion of the sleeve projecting from the liner), as well as the bottom of the cup, are each provided with a central opening it is possible by means of a suitable dispensing tube, whose free end passes through the above-mentioned two central openings, to cast the composition constituting the lipstick, when hot, into the mould cavity and into the upper space of the cup. When the composition has solidified, the whole unit of the mechanism then comprising its lipstick is withdrawn and by manipulating the above-mentioned wheel, the cup is retracted into its low position, the lipstick then being protected in the case. The drawback of this method, which uses volumetric casting through the whole of the mechanism, is that if a mishap occurs in casting the said whole unit must be rejected. Moreover, the casting is not very easy to carry out due to bubble formation.

In another method there is placed on a mould, provided with a plurality of holes opening in its top, a dish-shaped cover whose bottom is provided with openings which come to be positioned opposite the holes when the cover is in position. The liquid composition is poured into this dish, and when this composition has filled all the cavities of the mould the bottom of the cover is scraped for levelling off. The cover is then withdrawn which leaves the lipstick bases in relief, and a case, whose cup is in the high position, is presented opposite each base and the base is driven into the cup with a fouling risk similar to that of the first method described above. This embodiment leads to losses in the lipstick substance, as well as to time wastage in manufacture.

Another difficulty is because it is difficult to ensure a perfect hold of the lipstick in its cup, since the lipstick is a relatively soft product at its temperature of use. Moreover, in the case of the first method mentioned above, the more firmly the lipstick is gripped by the cup, the more difficult is the positioning of the lipstick by driving in. It is true that French patent No. 2548880 provides a solution for this problem by providing a cup which has at least a portion of its lateral wall projecting outwardly and which is pushed back radially inwardly when the cup is engaged in the sleeve so as to secure the lipstick in the cup. Here the lipstick is inserted manually with its base entering the cup before the cup is mounted in the sleeve. Although the hold of the base of the lipstick can thus be improved in the cup, there nevertheless remains the fact that this part of the manufacture of the cases is not automated and that precautions must still be taken for manipulating the lipstick.

OBJECTS OF THE INVENTION

It is an object of the present invention to allow all the above-mentioned drawbacks to be remedied.

It is a further object of the invention to make the cup in two tubular portions which are fitted to each other, the first serving to secure the lipstick substance, and the second comprising the studs intended to cooperate with the openings and grooves in the sleeve and liner respectively.

It is a still further object of the invention to dispose the first portion of the cup on the upper face of the mould so that the internal space which it delimits constitutes an extension of a cavity of the mould. The mould cavity and at least part of the space extending this cavity can then be filled, so as to ensure the hold of the lipstick with its base in the cup. A first point to be made is that in accordance with the invention, the casting of the lipstick is effected through a cup element, and not through the mechanism as a whole (which is the case of the second method of the above-mentioned prior art). If a casting mishap does occur, it is a single component and not the whole of the mechanism that has to be rejected. A second point is that the method of the invention does not require any scraping, as is the case with the third known method referred to above. From this point of view, the method of the invention makes it possible to prevent wastage of the product constituting the lipstick.

Moreover, in a particularly worthwhile embodiment of the present invention, this first cup portion comprises in its central portion, an inwardly directed substantially annular recess beyond which the cup can advantageously have a frusto-conical portion flaring in the direction opposite to that of the edge of the cup directed towards the moulding cavity. It follows that after the lipstick has solidified, it is rendered completely integral with this portion of the cup. On the one hand, it is held, in the direction of extraction—which is important for the withdrawal from the mould which will be described below—following the presence of the above-mentioned frusto-conical portion. On the other hand, it is held in the driving-in direction because of the presence of the recess which has also been mentioned above. A third point is therefore that the method of the invention considerably improves the hold of the lipstick once it has been cast, and this constitutes an important advantage over all the methods used hitherto.

The second portion of the cup is positioned in the rest of the mechanism and placed in the high position of the mechanism. This sub-assembly is axially disposed above a mould cavity containing a solidified lipstick and the first cup portion rendered integral with the base of the stick, the second cup portion being directed towards the said first cup portion, and the said sub-assembly is subjected to translation towards the bottom until the final fixing of the two cup portions to each other is obtained by catch-engagement which reconstitutes a cup of a conventional shape. The fourth point is that the fixing of the lipstick in the remaining part of the case mechanism does not involve any risk of producing rough edges, as was the case with the implementation of the first or the third known methods indicated above, since it is effected by cooperation of these two cup portions which are rigid elements.

Having fixed the two cup portions to each other, the case unit thus provided with its lipstick is axially withdrawn, then after extraction the lipstick is repositioned inside the case in the usual way.

It is yet a further object of the invention to provide a method which the additional advantages that the standard mechanisms (shell—liner—sleeve) can be used and it allows the production of lipstick cases in a semi-automated manner because the positioning of the first cup portion on the mould may be effected by a vibrating dish.

SUMMARY OF THE INVENTION

The present invention therefore provides firstly a method for the positioning of a lipstick in a lipstick holder case, said lipstick being obtained by the solidification of a composition which can be cast when hot into a cavity of a mould, said cavity opening out in the top of the said mould, and the lipstick having to be engaged with its base in a cup actuating its displacement in the case comprising: (a) disposing above each cavity of the mould a first tubular element intended to receive the base of the lipstick, and comprising catch-engagement means complementary to means carried by a second tubular element, the assembly of these first and second tubular elements constituting the cup associated with the lipstick; (b) casting the composition of the lipstick through the space delimited by the said first tubular element to fill said cavity and at least partly to fill said space; (c) after solidification of said composition, displacing axially towards each mould cavity an inverted lipstick holder case, with said second tubular element disposed in the upper portion thereof, until the catch-engagement of the said first and second tubular elements is obtained; and (d) withdrawing the case, with its thus received lipstick in the high position by axial upward translation and placing the lipstick in the low position inside the case by operating the mechanism of the case.

Preferably, a mould is used wherein the upper portion of each mould cavity comprises an annular counterbore whose base forms a recess, the first tubular element composing the cup being intended to be placed with its external free edge on the recess, that is to say, with its free edge nearest the end of the lipstick not connected to the cup.

The present invention also provides a lipstick holder case, comprising a stick of lipstick whose base is engaged in a cup, said cup actuating the displacement of the lipstick in relation to an external case, wherein said cup is constituted by the assembly of first and second tubular elements, of which said first tubular element receives the base of the lipstick and comprises catch-engagement means complementary to means carried by the second tubular element, and wherein said second tubular element comprises means complementary to means carried by the case for actuating the displacement of the cup relative to the case.

Preferably, a second tubular element is used which is capable of surrounding the first tubular element in the assembled position of these two elements. In particular, the first tubular element of the cup comprises an external peripheral catch-engagement ring near its free internal edge (opposed to its free external edge defined above) and an annular external stop in its central zone, the height of the second tubular element being substantially equal to the distance between the said stop and the said catch-engagement ring.

A first tubular cup element is then advantageously used comprising at least one axial slot which opens out at the free internal edge of the first tubular element.

Moreover, it is preferable to use a first tubular cup element comprising means for retaining the base of the lipstick in the extraction and/or insertion direction. In particular, this first tubular cup element can have an internal wall which is at least partly frusto-conical, flaring towards the lipstick base to constitute the means preventing extraction of the lipstick from the first tubular element and which may have internally an annular shoulder constituting the means for retaining the lipstick in the insertion direction into the cup.

In a preferred embodiment of the first tubular element, the internal annular shoulder indicated above forms externally the annular stop which cooperates with the second tubular element.

In the most usual embodiment, the second tubular element has two radially outwardly projecting studs which, on the one hand, each pass through a respective opening whose two ends each have a respective circumferentially extending slot, the direction of one slot at one end being opposite to that of the slot of the other end, this opening being arranged in the lateral wall of a cylindrical sleeve wherein the cup is displaceable substantially in an axial direction; said studs, on the other hand, each engage in a helical groove arranged in the internal wall of a cylindrical liner externally covered by a shell, the sleeve being axially retained relative to the shell and being mounted for free rotation around its axis.

BRIEF DESCRIPTION OF THE DRAWINGS

In order that the present invention may be more readily understood there will now be described an embodiment represented in the attached drawings by way of a purely illustrative and non-restrictive example. In these drawings.

DESCRIPTION OF THE PREFERRED EMBODIMENT

Figures 1, 2, 3:
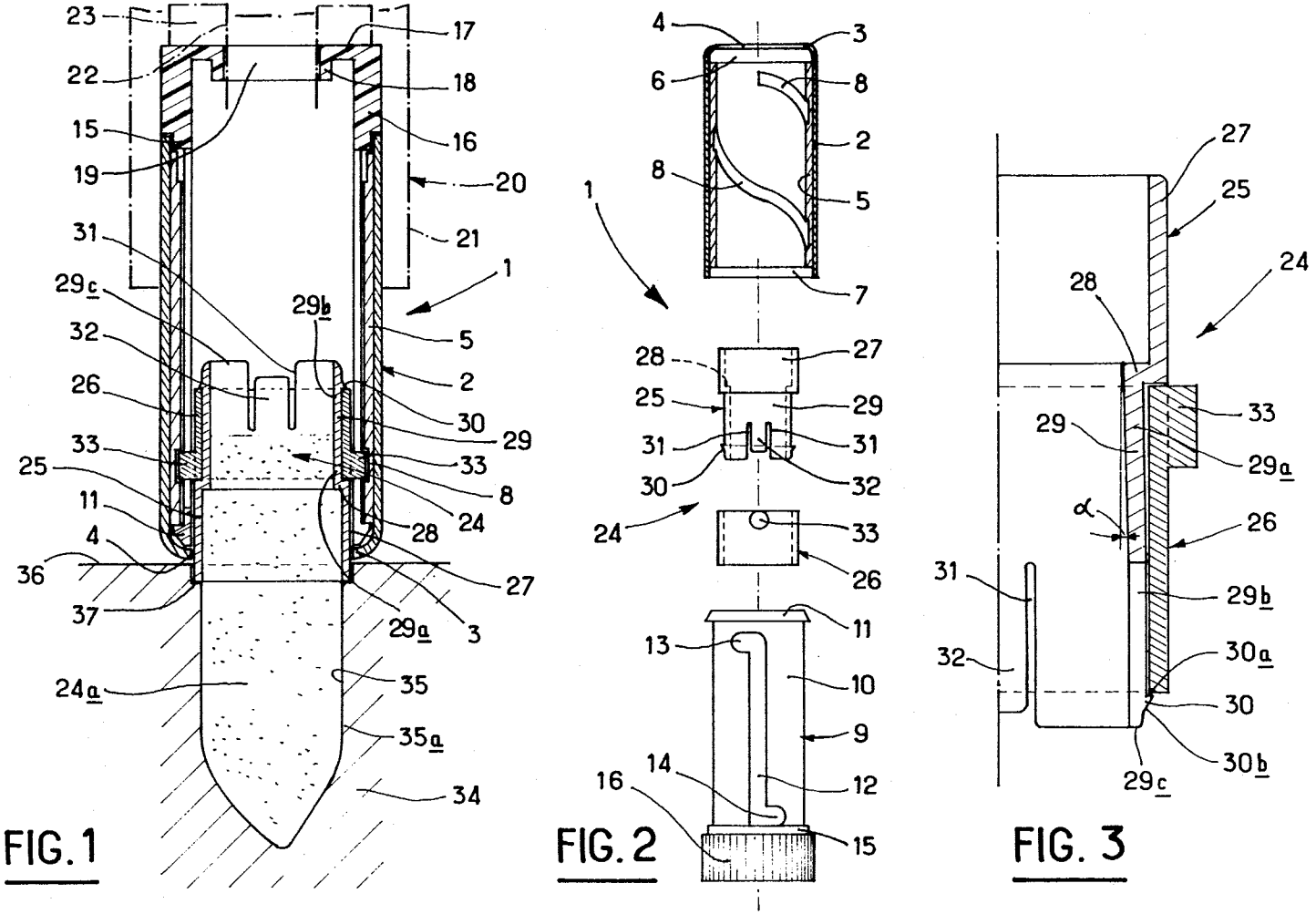
FIG. 1 is an axial cross-sectional view of a lipstick in the position it occupies relative to the mould used for the moulding of the lipstick.
FIG. 2 is an exploded view, partly in cross-section and partly in elevation, of the components of the lipstick unit of FIG. 1 with the exception of the stick which has been omitted for the sake of clarity.
FIG. 3 is a part view, in cross-section and on an enlarged scale, of the cup of the lipstick of FIG. 1.

Referring to FIG. 2, it will be seen that the lipstick unit designated as a whole by 1 comprises an external metallic shell, which is cylindrical in shape with a circular cross-section whose upper edge bent inwardly into a rounded rim 3 and which delimits a central circular opening 4. Within the shell 2, a thin cylindrical liner 5 of a plastic material is fixed in an axial position. The liner 5 has a circular cross-section, but is smaller in height than the shell 2, so as to delimit on the one hand, together with the rounded rim 3 of the shell 2, an upper chamber 6 and on the other hand, a lower annular housing 7 together with the lower end of the shell 2.

Two helical grooves 8, which are identical but diametrically opposed, are arranged in the internal side of the liner 5, in such a way that they do not open out at their upper and lower ends respectively into the circular upper and lower edges of the liner 5.

In the coaxial unit constituted by the shell 2 and the liner 5, there is a sleeve 9, made of a plastic material, and is mounted substantially coaxially. It is free for rotation around its axis, but is fixed in its axial position. The sleeve 9 comprises a main cylindrical circular cross-section tubular portion 10 with an external diameter slightly smaller than the internal diameter of the liner 5 and has its upper end formed into an axially retaining catch 11 which is accommodated in the upper chamber 6 when the tubular portion 10 is disposed in the liner 5. Two identical openings 12 extending axially over practically the whole height of the tubular portion 10 and having their upper and lower ends constituted by slots 13 and 14 extending in opposite circumferential directions, are arranged in diametrically opposed parts of the tubular portion 10. At its lower end, the tubular portion 10 is joined, via an external radial shoulder 15, to a cylindrical end fitting 16 whose internal diameter is equal to the external diameter of the tubular portion 10 and whose external diameter is practically equal to the external diameter of the shell 2. At its lower end, the end fitting 16 has an internal radial flange 17 provided with a peripheral rim 18 directed towards the tubular portion 10 and delimiting a central circular opening 19, (FIG. 1).

When the sleeve 9 is in position in the liner 5 of the shell 2, the external radial shoulder 15 is accommodated in the lower annular recess 7 so that the sleeve 9 is axially retained in the liner 5 against whose ends it bears with its catch 11 and its shoulder 15. On the other hand, the sleeve 9 can be driven in rotation around its axis in the liner 5 by manipulation of the end fitting 16 which, projecting below the liner 5 and the shell 2, is freely accessible.

A presentation cover 20, partly represented in broken lines, could be fitted on the end fitting 16. The presentation cover 20 comprises a peripheral skirt 21 which can be of a square cross-section and joined to a bottom which is not shown but which carries a central cylindrical skirt 22 intended to be force-fitted in the opening 19 of the end fitting 16 when the cover 20 is displaced axially towards the end fitting 16; at the end of travel, the annular end wall of a cylindrical rim 23 surrounding the central skirt 22 bears on the external annular wall of the flange 17.

A cup 24, of a generally cylindrical shape, is mounted in the sleeve 9. This cup, which is intended to accommodate a stick **24*a* of lipstick composition (FIG. 1) is made of two portions 25 and 26**.

The portion 25 is constituted by a cylindrical ring 27 which, at one of its ends, is bent inwardly at right angles to form an annular shoulder 28 at the free edge of which is a skirt 29 directed away from the ring 27. The skirt 29 has a height which is slightly greater than that of the ring 27 and comprises in succession, firstly, a frusto-conical intermediate portion **29*a* (FIG. 3) having a half angle alpha at the apex of approximately 5° and flaring in the opposite direction from the shoulder 28 and secondly, a cylindrical end portion 29*b***.

Moreover, as may be more readily seen in FIG. 3, the portion **29*b* comprises near its free internal edge 29*c* an external peripheral ring 30 delimited by an annular wall 30*a* which is substantially perpendicular to the portion 29*b* and a frusto-conical lateral wall 30*b* narrowing towards the edge 29*c***.

Axial slots 31 in the cylindrical portion **29*b* extend from its edge 29*c*, wherein each opens out in an enlarged neck, as far as an axial position situated substantially at the transition of the cylindrical portion 29*b* with the frustoconical portion 29*a*. The slots 31 are regularly distributed over the periphery of the cylindrical portion 29*b* and give rise to regularly disposed tabs 32 which are shorter than the rest of the said cylindrical portion 29*b***.

The portion 26 consists of a cylindrical ring whose diameter only very slightly exceeds the external diameter of the portion **29*b*. The height of this ring 26 corresponds to the distance separating the external wall of the shoulder 28 and the upper wall 30*a* of the peripheral ring 30. Moreover, the ring 26 has two cylindrical radially outwardly projecting studs 33 whose size is such that each of them passes through a respective opening 12 of the sleeve 9 and is engaged in a groove 8 of the liner 5 when the cup 24, constituted by the assembly of the portions 25 and 26, is in the appropriate position in the sleeve 9. The cup 24 is shown in the assembled state in FIGS. 1 and 3 where the ring 26 surrounding the skirt 29 of the portion 25 has one of its ends abutting the shoulder 28 and its other end abutting the wall 30*a* of the catch-engagement ring 30, the radial studs 33 being situated beside the shoulder 28**.

It will be understood that when the sleeve 9 is caused to rotate around its longitudinal axis in relation to the liner 5 and the shell 2, thanks to the guidance of the studs 33 ensured by the opening 12 and the grooves 8, the cup 24 is displaced axially in the tubular portion 10 of the sleeve 9 by being driven in rotation with this sleeve between two end positions. One is the bottom position where the studs 33 are located in the bottom ends of the grooves 8, and the openings 12, the slots 14 allowing locking in this position at the end of the rotational travel in one direction. The other end position is the top position where the studs 33 are located in the top ends of the grooves 8 and the openings 12, the slots 13 also ensuring locking in this position at the end of the rotational travel in the other direction.

The lipstick **24*a* may be positioned in the mechanism, which has just been described, as follows. A mould 34 (FIG. 1) is constituted by two half shells each formed by a vertical plate wherein there are formed two half mould cavities such that the two associated half mould cavities constitute one cavity 35 when the two half shells are brought together and secured to each other. The form of such cavity corresponds to that of the lipstick to be cast and comprises a cylindrical body and, in the conventional way, an oval-shaped and asymmetrical end to allow easier application to the lips. The cylindrical lateral wall 35*a* surrounding each cavity 35 intended to cast one lipstick 24*a* has, near the top 36 of the said mould 34, an annular counterbore whose base forms an annular recess 37 having a width equal to or slightly exceeding the thickness of the ring 27 of the portion 25 of the cup 24**.

The portions 25 of the cups 24 are then disposed axially on the top 36 of the mould, each portion 25 having its free external edge of its ring 27 abutting a said recess 37 surrounding a said counterbore of the mould 34. This positioning can be effected manually, or also in an automatic manner by a vibrating dish.

The composition of the lipstick **24*a* is then cast through the portions 25 of the cups 24 thus positioned. This filling may be effected by means of a volumetric filler device, and the filling level is stopped below the bottom of the slots 31**. The composition is allowed to cool.

The sub-assembly constituted by the shell 2 and sleeve 9 has been formed beforehand, and the presentation cover 20, if applicable, has been fixed thereto. The ring 26 of the cup 24 is inserted into this sub-assembly and is positioned in the high position, that is to say, in the position remote from the end fitting 16. Each sub-assembly thus formed is presented axially above each lipstick **24*a* and the associated cup portion 25, and the sub-assembly is pushed towards the cup element to obtain the catch-engagement of cup portion 25 with ring 26 as represented in FIG. 3. It then suffices to separate the two half shells of the moulds a little to release the cast lipsticks 24*a* to permit withdrawal of the unit in an axial translational movement which allows the unit 1 to be obtained, the lipstick 24*a* being in its extreme extended position. The lipstick 24*a* may be placed into its other extreme position by manipulating the end fitting 16 or, if applicable, the presentation cover 20, and the unit is closed by a conventional protective cap which for aesthetic reasons may, if presentation cover 20 is used, be situated in the extension of the cover 20**.

The existence of the frusto-conical portion **29*a* with a half angle alpha as described above, ensures the hold of the lipstick 24*a* in the cup 24 when it is extracted from the mould. Moreover, the shoulder 28 ensures a correct hold of the lipstick 24*a*** during use by preventing it from being driven into the cup.

It shall be duly understood that the embodiment described above is in no way restrictive, and may give rise to any desirable modifications without thereby departing from the scope of the invention.

I claim:

1. A lipstick holder case comprising:

(a) cup means for receiving a base of a stick of lipstick, said cup means including a first tubular element having an inwardly facing end and an outwardly facing end, a peripheral catch-engagement ring defined adjacent said inwardly facing end of said first tubular element, and an annular stop defined at a central zone of said first tubular element, said inwardly facing end of said first tubular element including means defining at least one axial slot which is open at said inward end and has a closed end axially spaced therefrom, said cup means further including a second tubular element mounted in surrounding relation to said first tubular element and having a length so as to extend between said catch-engagement ring and said annular external stop;

(b) a stick of lipstick having a base mounted within said outwardly facing end of said first tubular element such that the base of said stick of lipstick is mounted outwardly relative to said closed end of said slot; and (c) means for actuating said cup means for displacement of the lipstick relative to said case.

2. A lipstick holder case according to claim 1, wherein the first tubular element of the cup means comprises means for retaining the base of the lipstick in at least one of the extraction and insertion directions of said lipstick relative to the cup means.

3. A lipstick holder case according to claim 2, wherein the first tubular element of the cup means has an internal wall which is at least partly frusto-conical flaring towards the base of the lipstick and which constitutes said means retaining the stick in the extraction direction, and has internally an annular shoulder constituting said means for retaining the lipstick in the direction of insertion into the cup means.

4. A lipstick holder case according to claim 3, wherein the annular shoulder constitutes externally said annular stop which cooperates with said second tubular element of the cup means.

5. A lipstick holder case according to claim 1, wherein said case includes a cylindrical sleeve to surround said second tubular element, said sleeve including means defining at least one opening therein, having first and second ends; and wherein the second tubular element of the cup means has at least one radially outwardly projecting stud which, each pass through a said opening each of whose first and second ends has a respective slot means extending in a circumferential direction, the direction of a said slot means at said first end of the opening being opposite to that of the slot of said second end, said opening being arranged in the lateral wall of said cylindrical sleeve; wherein the cup means is displaceable substantially in an axial direction and, wherein said case further includes (i) a cylindrical liner coaxial with said cylindrical sleeve, said cylindrical liner including helical groove means in the internal wall thereof, and (ii) a shell surrounding said cylindrical liner; and wherein said stud each engage in said helical groove means, the sleeve being axially retained relative to the shell and being mounted for free rotation around its axis.

6. A method of positioning a lipstick in a lipstick holder case, said lipstick being formed by the solidification of a composition which is cast when hot into a cavity of a mold, the cavity opening upwardly of the mold, the lipstick being molded so that its base is defined in a cup of a lipstick holder case mounted for displacement in the case, the method comprising the steps of:

(a) providing a cup of a lipstick holder case, said cup including a first tubular element for receiving the base of the lipstick, said first tubular element including a first, inwardly facing end and a second, outwardly facing end relative to said case, said first tubular element including an external peripheral catch-engagement ring adjacent its innermost edge and an annular stop in a central zone thereof, said innermost end of said first tubular element including at least one axial slot which is open at the innermost edge of the first tubular element and has a closed end axially spaced therefrom, said cup further including a second tubular element for mounting in surrounding relation to a portion of said first tubular element and being substantially equal in length to the distance between said annular stop and said catch-engagement ring of said first tubular element;

(b) disposing said first tubular element of said cup above a mold cavity of a mold such that the outwardly facing end of said first element is in facing relation to said mold cavity;

(c) casting the composition of the lipstick through a space defined by the first tubular element so as to fill said cavity and at least partially fill the space defined by said first tubular element such that the molded lipstick base is disposed outwardly relative to said closed end of each said slot;

(d) after solidification of said composition, displacing the lipstick holder case, inverted, with said second tubular element mounted in an uppermost portion thereof, axially towards the mold cavity until catch engagement of the first and said second tubular elements is obtained; and (e) withdrawing the case from the mold cavity by axial upward translation and placing the lipstick within the case by operating a mechanism of the case.

7. A method according to claim 6, wherein the step of disposing a first tubular element above each mold cavity includes disposing a first tubular element above a mold cavity that includes a counterbore and placing the outwardly facing end of said first tubular element on the base of said counterbore.

* * * * *